US009552796B2

(12) United States Patent
Lee et al.

(10) Patent No.: US 9,552,796 B2
(45) Date of Patent: Jan. 24, 2017

(54) DEGRADATION COMPENSATING PIXEL CIRCUIT AND ORGANIC LIGHT EMITTING DIODE DISPLAY DEVICE INCLUDING THE SAME

(71) Applicant: SAMSUNG DISPLAY CO., LTD., Yongin, Gyeonggi-Do (KR)

(72) Inventors: Tak-Young Lee, Anyang-si (KR); Yong-Sung Park, Seoul (KR); Young-In Hwang, Suwon-si (KR); Chul-Kyu Kang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 34 days.

(21) Appl. No.: 14/628,127

(22) Filed: Feb. 20, 2015

(65) Prior Publication Data

US 2016/0063943 A1 Mar. 3, 2016

(30) Foreign Application Priority Data

Sep. 3, 2014 (KR) ..... 10-2014-0117287

(51) Int. Cl.
*G09G 5/18* (2006.01)
*G09G 3/32* (2016.01)

(52) U.S. Cl.
CPC ..... *G09G 5/18* (2013.01); *G09G 3/3233* (2013.01); *G09G 2300/0852* (2013.01); (Continued)

(58) Field of Classification Search
CPC ..... G09G 2300/0852; G09G 2300/0861; G09G 2310/0262; G09G 2320/046; G09G 3/3233; G09G 5/18
See application file for complete search history.

(56) References Cited

U.S. PATENT DOCUMENTS

2006/0055336 A1* 3/2006 Jeong ..... G09G 3/3233 315/169.3
2009/0225013 A1 9/2009 Lee et al.
(Continued)

FOREIGN PATENT DOCUMENTS

CN 103943063 A 7/2014
KR 10-0911981 B1 8/2009
(Continued)

*Primary Examiner* — Latanya Bibbins
(74) *Attorney, Agent, or Firm* — Lewis Roca Rothgerber Christie LLP

(57) ABSTRACT

A degradation compensating pixel circuit includes: an organic light emitting diode (OLED); a driving circuit including a first capacitor and a first transistor, the first capacitor being configured to be charged in response to a data signal and a scan signal, the first transistor being configured to drive the OLED according to a first voltage between first and second terminals of the first capacitor, the first terminal of the first capacitor being configured to receive a supply voltage, the second terminal of the first capacitor being coupled to a gate terminal of the first transistor; and a degradation compensating circuit coupled to a source terminal of the first transistor and the gate terminal of the first transistor, the degradation compensating circuit being configured to change the first voltage according to a first current of the first transistor.

15 Claims, 10 Drawing Sheets

(52) U.S. Cl.
CPC ..... *G09G 2300/0861* (2013.01); *G09G 2310/0251* (2013.01); *G09G 2310/0262* (2013.01); *G09G 2320/046* (2013.01)

(56) References Cited

U.S. PATENT DOCUMENTS

| | | | | |
|---|---|---|---|---|
| 2010/0044691 | A1 | 2/2010 | Hong et al. | |
| 2013/0307885 | A1* | 11/2013 | Shin | G09G 3/3275 345/691 |
| 2013/0335391 | A1 | 12/2013 | Kim | |
| 2014/0062843 | A1 | 3/2014 | Yang et al. | |
| 2014/0198136 | A1* | 7/2014 | Lee | G09G 3/3266 345/690 |

FOREIGN PATENT DOCUMENTS

| | | | |
|---|---|---|---|
| KR | 10-0932989 | B1 | 12/2009 |
| KR | 10-2013-0140426 | A | 12/2013 |
| KR | 10-2014-0029795 | A | 3/2014 |
| KR | 10-2014-0137272 | A | 12/2014 |

* cited by examiner

DEGRADATION COMPENSATING PIXEL CIRCUIT AND ORGANIC LIGHT EMITTING DIODE DISPLAY DEVICE INCLUDING THE SAME

CROSS-REFERENCE TO RELATED APPLICATION(S)

This application claims priority to and the benefit of Korean Patent Application No. 10-2014-0117287, filed on Sep. 3, 2014 in the Korean Intellectual Property Office (KIPO), the content of which is incorporated herein in its entirety by reference.

BACKGROUND

1. Field

One or more aspects of example embodiments relate generally to a pixel circuit.

2. Description of the Related Art

Since an organic light emitting diode (OLED) display device displays an image using an organic light emitting diode that generates light, the OLED display device doesn't need a light source (e.g., backlight unit), unlike a liquid crystal display device. Thus, the OLED display device may be relatively thin and light. In addition, the OLED display device may have low power consumption, improved luminance, improved response speed, etc., when compared to the liquid crystal display device. Hence, the OLED display device is widely used as a display device included in an electronic device.

In a case of pixel circuits which display a logo (e.g. NBC, CBS), and thus, display the same pattern consistently with high luminance in the display panel of the OLED display device, mobility of the driving transistors are degraded because of consistent strong currents. After degradation of the pixel circuits, image sticking occurs on the pixel circuits so that viewers may observe the logo on another image that does not include the logo.

SUMMARY

One or more aspects of example embodiments provide a pixel circuit for compensating current reduction caused by degradation of a driving transistor.

One or more aspects of example embodiments provide an organic light emitting diode (OLED) display device including a pixel circuit for compensating current reduction caused by degradation of a driving transistor.

According to some example embodiments, a degradation compensating pixel circuit includes: an organic light emitting diode (OLED); a driving circuit including a first capacitor and a first transistor, the first capacitor being configured to be charged in response to a data signal and a scan signal, the first transistor being configured to drive the OLED according to a first voltage between first and second terminals of the first capacitor, the first terminal of the first capacitor being configured to receive a supply voltage, the second terminal of the first capacitor being coupled to a gate terminal of the first transistor; and a degradation compensating circuit coupled to a source terminal of the first transistor and the gate terminal of the first transistor, the degradation compensating circuit being configured to change the first voltage according to a first current of the first transistor.

In an example embodiment, the degradation compensating circuit may be configured to increase the first current by increasing the first voltage and decreasing a voltage of the gate terminal of the first transistor when the first current is reduced by the degradation of the first transistor.

In an example embodiment, the first current may flow from the source terminal of the first transistor to a drain terminal of the first transistor through the first transistor when the OLED emits light.

In an example embodiment, the degradation compensating circuit may include a second transistor, a third transistor, and a second capacitor. A source terminal of the second transistor may be configured to receive a reference voltage, a gate terminal of the second transistor may be configured to receive a feedback initialization signal, and a drain terminal of the second transistor may be coupled to a first node. A source terminal of the third transistor may be coupled to the first node, a gate terminal of the third transistor may be configured to receive a feedback signal, and a drain terminal of the third transistor may be coupled to the source terminal of the first transistor. A first terminal of the second capacitor may be coupled to the first node, and a second terminal of the second capacitor may be coupled to the gate terminal of the first transistor.

In an example embodiment, the degradation compensating circuit may be configured to charge the second capacitor during a first period when the feedback initialization signal is activated so that a second voltage between the first and second terminals of the second capacitor becomes a voltage difference between the reference voltage and an initialization voltage.

In an example embodiment, the degradation compensating pixel circuit may be configured to change the first voltage by a voltage distribution between the first capacitor and the second capacitor through a second current during a second period when the feedback signal is activated and an enable signal is activated.

In an example embodiment, an amount of the second current between the first capacitor and the second capacitor may be proportional to an amount of the first current.

In an example embodiment, the second period may be after the first period.

In an example embodiment, a capacitance of the second capacitor may be larger than a capacitance of the first capacitor.

In an example embodiment, the driving circuit may further include second, third, fourth, and fifth transistors. A source terminal of the second transistor may be configured to receive the data signal, a gate terminal of the second transistor may be configured to receive the scan signal, and a drain terminal of the second transistor may be coupled to a first node. A source terminal of the third transistor may be coupled to the first node, a gate terminal of the third transistor may be configured to receive a feedback initialization signal, and a drain terminal of the third transistor may be configured to receive an initialization voltage. A source terminal of the fourth transistor may be configured to receive the supply voltage, a gate terminal of the fourth transistor may be configured to receive an enable signal, and a drain terminal of the fourth transistor may be coupled to a second node. The source terminal of the first transistor may be coupled to the second node, and the gate terminal of the first transistor may be coupled to the first node. A source terminal of the fifth transistor may be coupled to a drain terminal of the first transistor, a gate terminal of the fifth transistor may be configured to receive the enable signal, and a drain terminal of the fifth transistor may be coupled to a first terminal of the OLED. A second terminal of the OLED may be configured to receive a ground voltage.

In an example embodiment, the driving circuit may be configured to charge the first capacitor according to the data signal when the scan signal is activated.

In an example embodiment, the OLED may be configured to emit light when the enable signal is activated.

In an example embodiment, the driving circuit may further include second, third, fourth, fifth, sixth, and seventh transistors. A source terminal of the second transistor may be configured to receive the data signal, a gate terminal of the second transistor may be configured to receive the scan signal, and a drain terminal of the second transistor may be coupled to a first node. A source terminal of the third transistor may be configured to receive the supply voltage, a gate terminal of the third transistor may be configured to receive an enable signal, and a drain terminal of the third transistor may be coupled to the first node. A source terminal of the fourth transistor may be configured to receive the supply voltage, a gate terminal of the fourth transistor may be configured to receive an initialization signal, and a drain terminal of the fourth transistor may be coupled to the first node. The source terminal of the first transistor may be coupled to the first node, the gate terminal of the first transistor may be coupled to a second node, and a drain terminal of the first transistor may be coupled to a third node. A source terminal of the fifth transistor may be coupled to the third node, a gate terminal of the fifth transistor may be configured to receive the enable signal, and a drain terminal of the fifth transistor may be coupled to a first terminal of the OLED. A source terminal of the sixth transistor may be coupled to the third node, a gate terminal of the sixth transistor may be configured to receive the scan signal, and a drain terminal of the sixth transistor may be coupled to the second node. A source terminal of the seventh transistor may be coupled to the second node, a gate terminal of the seventh transistor may be configured to receive the initialization signal, and a drain terminal of the seventh transistor may be configured to receive an initialization voltage. A second terminal of the OLED may be configured to receive a ground voltage.

In an example embodiment, the driving circuit may be configured to change the first voltage to compensate threshold voltage difference of the first transistor in response to the initialization signal and the scan signal.

In an example embodiment, the driving circuit may further include second, third, fourth, fifth, sixth, seventh, and eighth transistors, and a second capacitor. A source terminal of the second transistor may be configured to receive the data signal, a gate terminal of the second transistor may be configured to receive the scan signal, and a drain terminal of the second transistor may be coupled to a first node. A first terminal of the second capacitor may be coupled to the first node, and a second terminal of the second capacitor may be configured to receive an initialization voltage. A source terminal of the third transistor may be coupled to the first node, a gate terminal of the third transistor may be configured to receive a compensation signal, and a drain terminal of the third transistor may be coupled to a second node. A source terminal of the fourth transistor may be configured to receive the supply voltage, a gate terminal of the fourth transistor may be configured to receive an enable signal, and a drain terminal of the fourth transistor may be coupled to the second node. A source terminal of the fifth transistor may be configured to receive the supply voltage, a gate terminal of the fifth transistor may be configured to receive an initialization signal, and a drain terminal of the fifth transistor may be coupled to the second node. The source terminal of the first transistor may be coupled to the second node, the gate terminal of the first transistor may be coupled to a third node, and a drain terminal of the first transistor may be coupled to a fourth node. A source terminal of the sixth transistor may be coupled to the fourth node, a gate terminal of the sixth transistor may be configured to receive the enable signal, and a drain terminal of the sixth transistor may be coupled to a first terminal of the OLED. A source terminal of the seventh transistor may be coupled to the fourth node, a gate terminal of the seventh transistor may be configured to receive the compensation signal, and a drain terminal of the seventh transistor may be coupled to the third node. A source terminal of the eighth transistor may be coupled to the third node, a gate terminal of the eighth transistor may be configured to receive the initialization signal, and a drain terminal of the eighth transistor may be configured to receive the initialization voltage. A second terminal of the OLED may be configured to receive a ground voltage.

According to some example embodiments, an organic light emitting diode (OLED) display device includes: a timing controller configured to generate a data driver control signal and a scan driver control signal according to an input image data signal; a display panel including a plurality of degradation compensating pixel circuits; a data driver configured to generate data signals according to the data driver control signal, and to provide the data signals to the degradation compensating pixel circuits through a plurality of data lines; a scan driver configured to generate scan signals according to the scan driver control signal, and to provide the scan signals to the degradation compensating pixel circuits through a plurality of scan lines; and a power supply configured to provide a supply voltage and a ground voltage to the display panel to operate the display panel, each of the degradation compensating pixel circuits including: an organic light emitting diode (OLED); a driving circuit including a capacitor and a driving transistor, the capacitor being configured to be charged in response to a data signal from among the data signals and a scan signal from among the scan signals, the driving transistor being configured to drive the OLED according to a voltage between first and second terminals of the capacitor, the first terminal of the capacitor being configured to receive a supply voltage, the second terminal of the capacitor being coupled to a gate terminal of the driving transistor; and a degradation compensating circuit coupled to a source terminal of the driving transistor and the gate terminal of the driving transistor, the degradation compensating circuit being configured to change a voltage between the first and second terminals of the capacitor according to a current of the driving transistor.

As described above, a degradation compensating pixel circuit and an OLED display device including the degradation compensating pixel circuit may minimize or reduce image sticking by compensating current reduction of a driving transistor included in the pixel circuit that displays same patterns consistently with high luminance.

BRIEF DESCRIPTION OF THE DRAWINGS

Illustrative, non-limiting aspects of example embodiments will be more clearly understood from the following detailed description taken in conjunction with the accompanying drawings.

DETAILED DESCRIPTION

Figure 1:
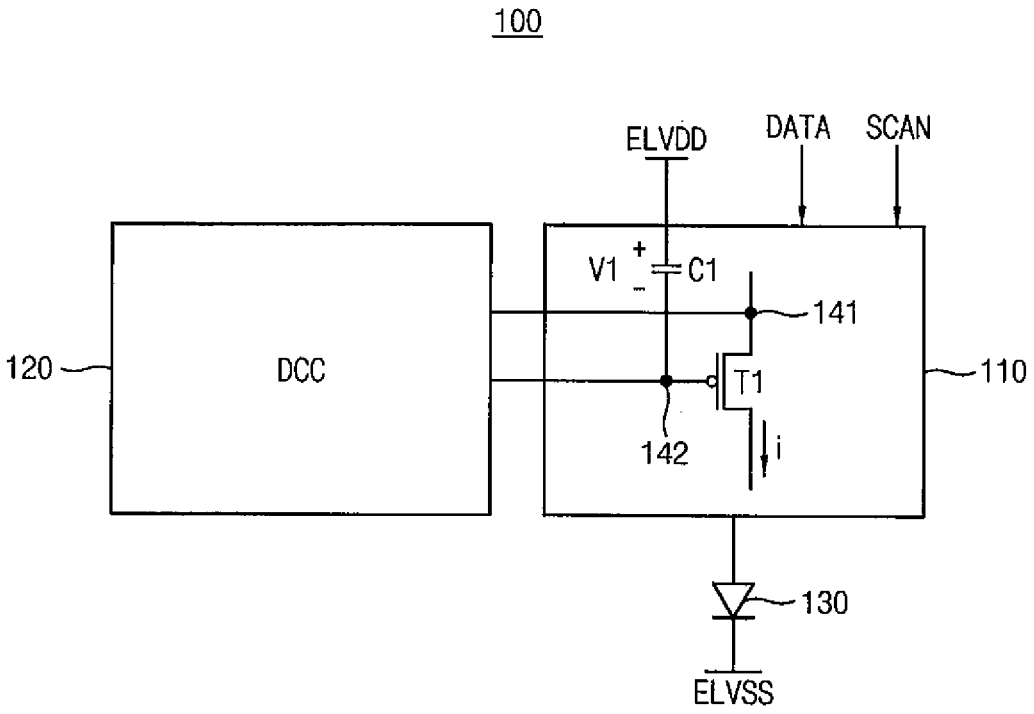
FIG. 1 is a block diagram illustrating a degradation compensating pixel circuit according to an example embodiment.

Various example embodiments will be described more fully hereinafter with reference to the accompanying drawings, in which some example embodiments are shown. The present inventive concept may, however, be embodied in various different forms and should not be construed as limited to the example embodiments set forth herein. Rather, these example embodiments are provided so that this disclosure will be thorough and complete, and will fully convey the spirit and scope of the present inventive concept to those skilled in the art. In the drawings, the sizes and relative sizes of layers and regions may be exaggerated for clarity. Like reference numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the spirit and scope of the present inventive concept. As used herein, the term "and/or" includes any and all combinations of one or more of the associated listed items. Expressions such as "at least one of," when preceding a list of elements, modify the entire list of elements and do not modify the individual elements of the list.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises," "comprising," "includes," "including," and the like when used in this specification, specify the presence of stated features, integers, steps, operations, elements, and/or components, but do not preclude the presence or addition of one or more other features, integers, steps, operations, elements, components, and/or groups thereof. As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present inventive concept refers to one or more embodiments of the present inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art, and should not be interpreted in an idealized or overly formal sense, unless expressly so defined herein.

Figure 2:
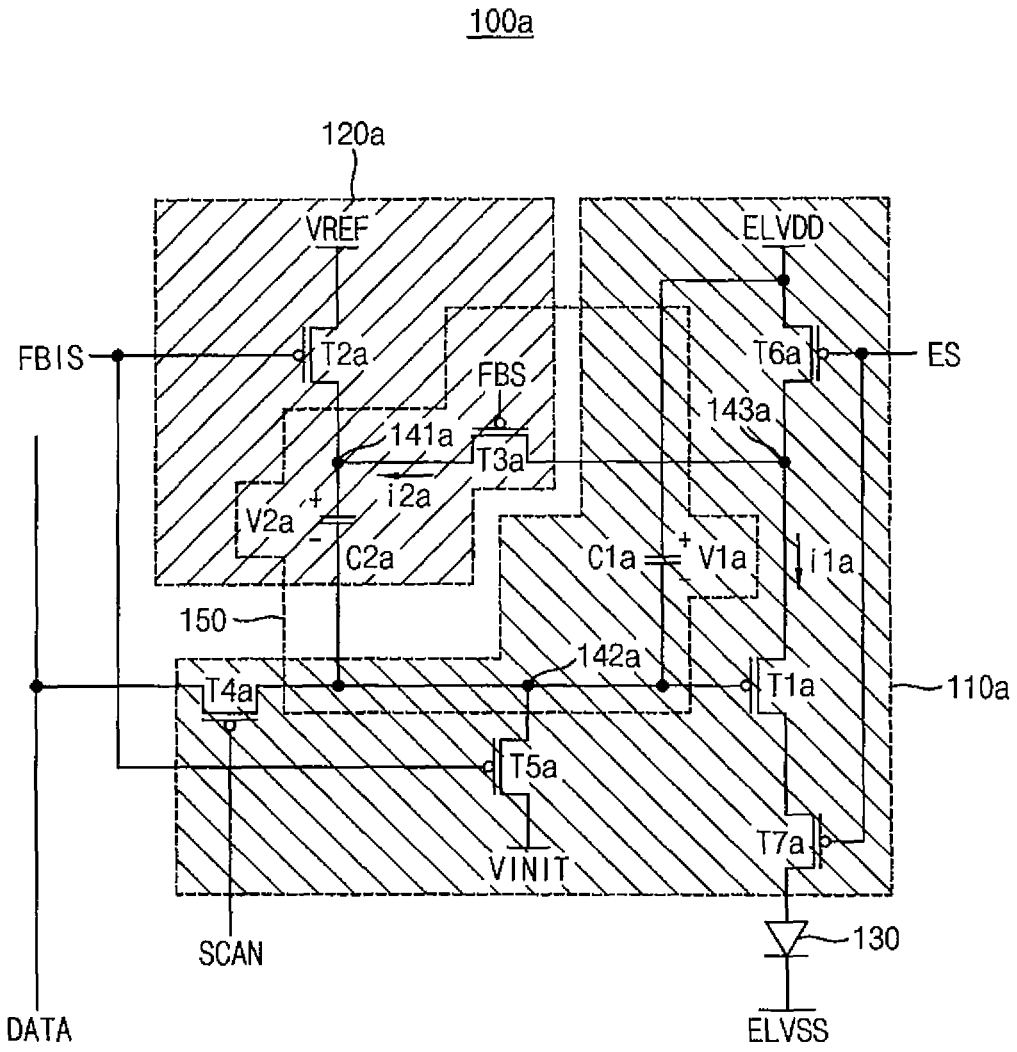
FIG. 2 is a schematic diagram illustrating a degradation compensating pixel circuit according to an example embodiment.

FIG. 1 is a block diagram illustrating a degradation compensating pixel circuit according to an example embodiment, and FIG. 2 is a schematic diagram illustrating a degradation compensating pixel circuit according to an example embodiment. While the FIGS. show PMOS transistors, the present inventive concept is not limited thereto, and those skilled in the art would know how to design similar circuits using NMOS or any other suitable types of transistors.

Referring to FIG. 1, a degradation compensating pixel circuit 100 includes an organic light emitting diode (OLED) 130, a driving circuit 110, and a degradation compensating circuit DCC 120. The driving circuit 110 includes a first capacitor C1 and a first transistor T1 (e.g., a PMOS transistor). The first capacitor C1 is charged in response to a data signal DATA and a scan signal SCAN. The first transistor T1 drives the OLED 130 based on a first voltage V1 between two terminals of the first capacitor C1. The first terminal of the first capacitor C1 receives a supply voltage ELVDD. The second terminal of the first capacitor C1 is coupled (e.g., connected) to a gate terminal 142 of the first transistor T1. The degradation compensating circuit 120 is coupled to a source terminal 141 of the first transistor T1 and the gate terminal 142 of the first transistor T1, respectively. The degradation compensating circuit 120 changes the first voltage V1 based on a first current i of the first transistor T1.

The first current i may be a current flowing from the source terminal 141 of the first transistor T1 to the drain terminal of the first transistor T1 through inside of the first transistor T1 when the OLED 130 emits light. The degradation compensating circuit 120 may increase the first current i by increasing the first voltage V1, and decreasing a voltage of the gate terminal 142 of the first transistor T1, when the first current i is reduced because of the degradation of the first transistor T1. Procedure of increasing the first current i will be described below with the reference to FIGS. 4 through 6.

Referring to FIG. 2, the degradation compensating pixel circuit 100*a* is one example embodiment of the degradation compensating pixel circuit 100 according to FIG. 1. However, the present inventive concept is not limited thereto, and the degradation compensating pixel circuit 100 shown in FIG. 1 may be implemented with various forms other than the degradation compensating pixel circuit 100*a* shown in FIG. 2.

The degradation compensating pixel circuit 100*a* shown in FIG. 2 includes an organic light emitting diode (OLED) 130, a driving circuit 110*a*, and a degradation compensating circuit 120*a*. The driving circuit 110*a* includes a first transistor T1*a* (e.g., a PMOS transistor), fourth through seventh transistors T4*a*, T5*a*, T6*a*, and T7*a* (e.g., PMOS transistors), and a first capacitor C1*a*. The degradation compensating circuit 120*a* includes second and third transistors T2*a* and T3*a* (e.g., PMOS transistors), and a second capacitor C2*a*.

A reference voltage VREF may be applied to a source terminal of the second transistor T2*a*, a feedback initialization signal FBIS may be applied to a gate terminal of the second transistor T2*a*, and a drain terminal of the second transistor T2*a* may be coupled (e.g., connected) to a first node 141*a*. A source terminal of the third transistor T3*a* may be coupled to the first node 141*a*, a feedback signal FBS may be applied to a gate terminal of the third transistor T3*a*, and a drain terminal of the third transistor T3*a* may be coupled to the source terminal of the first transistor T1*a* through a third node 143*a*. A first terminal of the second capacitor C2*a* may be coupled to the first node 141*a*, and a second terminal of the second capacitor C2*a* may be coupled to the gate terminal of the first transistor T1*a* through a second node 142*a*.

A source terminal of the fourth transistor T4*a* may receive a data signal DATA, a gate terminal of the fourth transistor T4*a* may receive a scan signal SCAN, and a drain terminal of the fourth transistor T4*a* may be coupled to the second node 142*a*. A source terminal of the fifth transistor T5*a* may be coupled to the second node 142*a*, a gate terminal of the fifth transistor T5*a* may receive the feedback initialization signal FBIS, and a drain terminal of the fifth transistor T5*a* may receive an initialization voltage VINIT. A source terminal of the sixth transistor T6*a* may receive a supply voltage ELVDD, a gate terminal of the sixth transistor T6*a* may receive an enable signal ES, and a drain terminal of the sixth transistor T6*a* may be coupled to the third node 143*a*. The source terminal of the first transistor T1*a* may be coupled to the third node 143*a*, and the gate terminal of the first transistor T1*a* may be coupled to the second node 142*a*. A source terminal of the seventh transistor T7*a* may be coupled to a drain terminal of the first transistor T1*a*, a gate terminal of the seventh transistor T7*a* may receive the enable signal ES, and a drain terminal of the seventh transistor T7*a* may be coupled to a first terminal of the OLED 130. A second terminal of the OLED 130 may receive a ground voltage ELVSS.

The first current i1*a* may be a current flowing from the source terminal of the first transistor T1*a* to the drain terminal of the first transistor T1*a* through inside of the first transistor T1*a* when the OLED 130 emits light. The second current i2*a* may be a current flowing from the third node 143*a* to the first node 141*a* through the third transistor T3*a* when the feedback signal FBS is activated. An amount of the second current I2*a* may be proportional to an amount of the first current i1*a*. A capacitance of the second capacitor C2*a* may be larger than a capacitance of the first capacitor C1*a*.

A first circuit 150 includes the third transistor T3*a* and the first and second capacitors C1*a* and C2*a*. Operation of the first circuit 150 will be described below with references to FIGS. 5 and 6.

Figure 3:
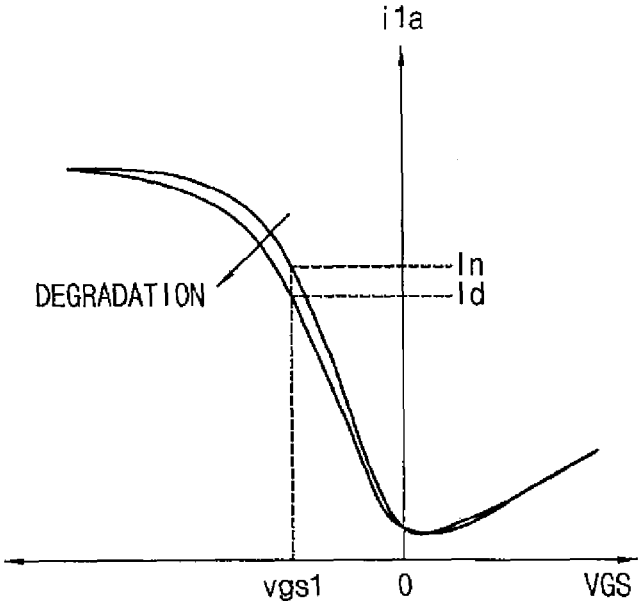
FIG. 3 is a graph illustrating degradation of a first transistor included in the degradation compensating pixel circuit shown in FIG. 2.

FIG. 3 is a graph illustrating degradation of the first transistor included in the degradation compensating pixel circuit shown in FIG. 2.

Referring to FIG. 3, the X-axis indicates an applied voltage VGS between the source terminal of the first transistor T1*a* and the gate terminal of the first transistor T1*a*. The Y-axis indicates the first current i1*a* of the first transistor T1*a*.

The upper curve shows a relationship between the applied voltage VGS and the first current i1*a* when the first transistor T1*a* is not degraded. The lower curve shows a relationship between the applied voltage VGS and the first current i1*a* when the first transistor T1*a* is degraded.

When a first voltage vgs1 is provided as the applied voltage VGS, the first current i1*a* inside the first transistor T1*a*, which is not degraded, is equal to In. When a first voltage vgs1 is provided as the applied voltage VGS, the first current i1*a* inside the first transistor T1*a*, which is degraded, is equal to Id that is lower than In.

Figure 4:
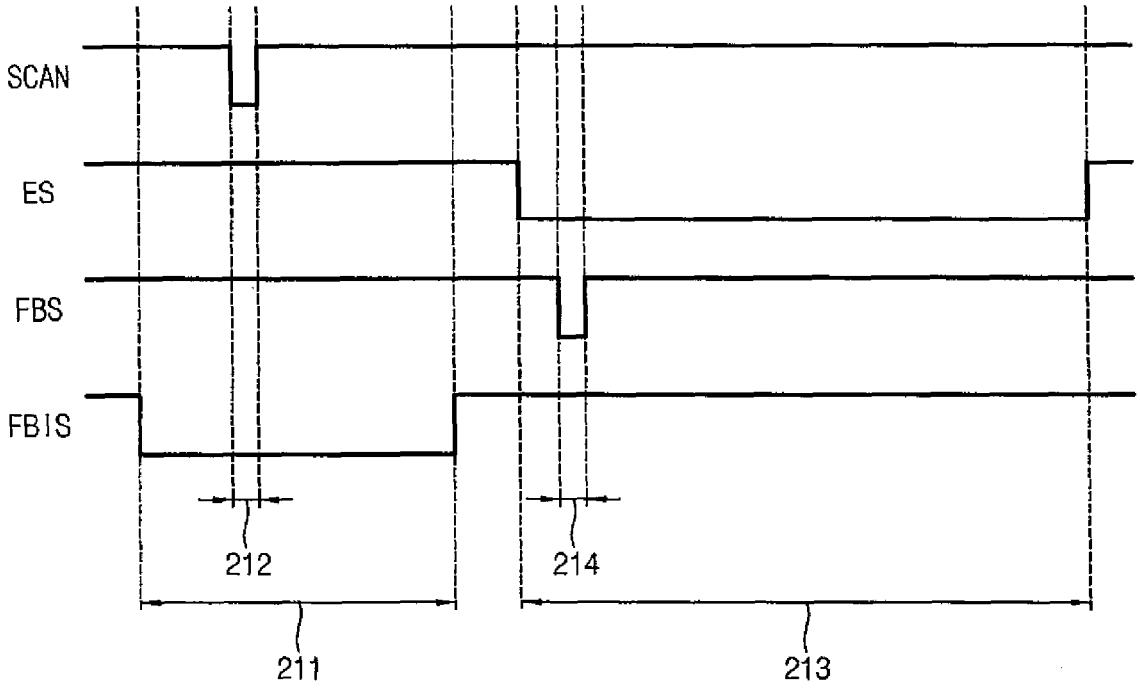
FIG. 4 is a timing diagram illustrating operation of the degradation compensating pixel circuit shown in FIG. 2.

FIG. 4 is a timing diagram illustrating operation of the degradation compensating pixel circuit shown in FIG. 2.

Referring to FIG. 4, the degradation compensating circuit 120*a* may charge the second capacitor C2*a* during a first period 211 when the feedback initialization signal FBIS is activated, so that a second voltage V2*a* between the two terminals of the second capacitor C2*a* becomes a voltage difference between the reference voltage VREF and the initialization voltage VINIT. The driving circuit 110*a* may charge the first capacitor C1*a* in response to the data signal DATA during a second period 212 when the scan signal SCAN is activated. The OLED 130 may emit light during a third period 213 when the enable signal ES is activated. The degradation compensating pixel circuit 100 may change the first voltage V1*a* by voltage distribution between the first capacitor C1*a* and the second capacitor C2*a* through the second current i2*a* during a fourth period 214 when the feedback signal FBS is activated and the enable signal ES is activated. Procedure of the voltage distribution between the first capacitor C1*a* and the second capacitor C2*a* through the second current i2*a* will be described with references to FIGS. 5 and 6.

Figure 5:
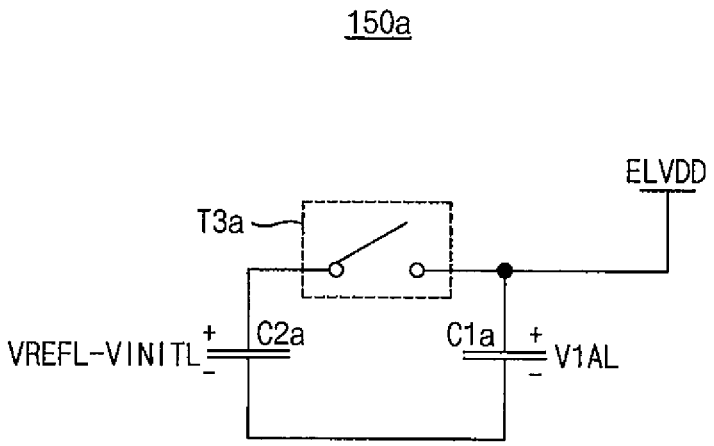
FIGS. 5 and 6 are equivalent circuit diagrams of a first circuit included in the degradation compensating pixel circuit shown in FIG. 2.
Figure 6:
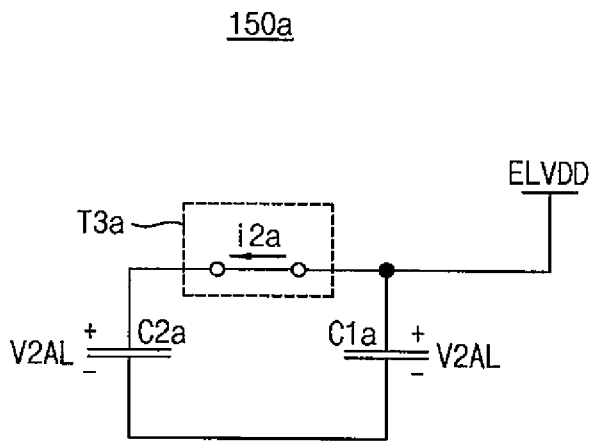

FIGS. 5 and 6 are equivalent circuits of the first circuit included in the degradation compensating pixel circuit shown in FIG. 2.

FIG. 5 illustrates a first equivalent circuit of the first circuit 150 included in the degradation compensating pixel circuit 100*a* shown in FIG. 2 just before the fourth period 214 when the feedback signal FBS is not activated. The source terminal of the third transistor T3*a* and the drain terminal of the third transistor T3*a* are not electrically coupled (e.g., electrically connected). The second capacitor C2*a* is charged so that the second voltage V2*a* between the two terminals of the second capacitor C2*a* becomes a voltage difference VREFL−VINITL between the reference voltage level VREFL and the initialization voltage level VINITL during the first period 211. The first capacitor C1*a* is charged so that the first voltage V1*a* between the two terminals of the first capacitor C1*a* becomes the first voltage level V1AL during the second period 212.

FIG. 6 illustrates a second equivalent circuit of the first circuit 150 included in the degradation compensating pixel circuit 100*a* shown in FIG. 2 during the fourth period 214 when the feedback signal FBS is activated. The source terminal of the third transistor T3*a* and the drain terminal of the third transistor T3*a* are electrically coupled. A sum of a charge of the first capacitor C1*a* (Q1=C1*a(VREFL−VINITL)) and a charge of the second capacitor C2***a*

(Q2=C2*a*VIAL) in FIG. 5 is maintained in FIG. 6, and the charges move so that a level of the first voltage V1*a* and a level of the second voltage V2*a* become equal. In a transient state, charges move. In a steady state, charges do not move. In general, because VREFL−VINITL is less than VIAL, as time passes, the level of the first voltage V1*a* falls/approaches V2AL. If the level of the first voltage V1*a* and the level of the second voltage V2*a* becomes the second voltage level V2AL, the following Equation 1 describes maintenance of the charges.

$$(C1a+C2a)*V2AL=C1a*(VREFL-VINITL)+C2a*V1AL$$

$$V2AL=C1a/(C1a+C2a)*(VREFL-VINITL)+C2a/(C1a+C2a)*V1AL \quad \text{Equation 1}$$

The fourth period 214 is a short time in which the first capacitor C1*a* and the second capacitor C2*a* operate in the transient state within the fourth period 214. When the second current i2*a* decreases, the rate at which the first voltage V1*a* approaches V2AL is reduced, such that the magnitude of the first voltage V1*a* becomes relatively large at the point where the fourth period 214 ends.

The first transistor T1*a*, which is degraded, has a lower current as the first current i1*a* compared to the first transistor T1*a*, which is not degraded. The first transistor T1*a*, which is degraded, has a lower current as the second current i2*a* that is proportional to the first current i1*a*. Therefore, the first voltage V1*a* increases proportionally right after the fourth period 214, a voltage of the gate terminal of the first transistor T1*a* decreases, and the first current i1*a* of the first transistor T1*a* is compensated to have a higher current value.

Figure 7:
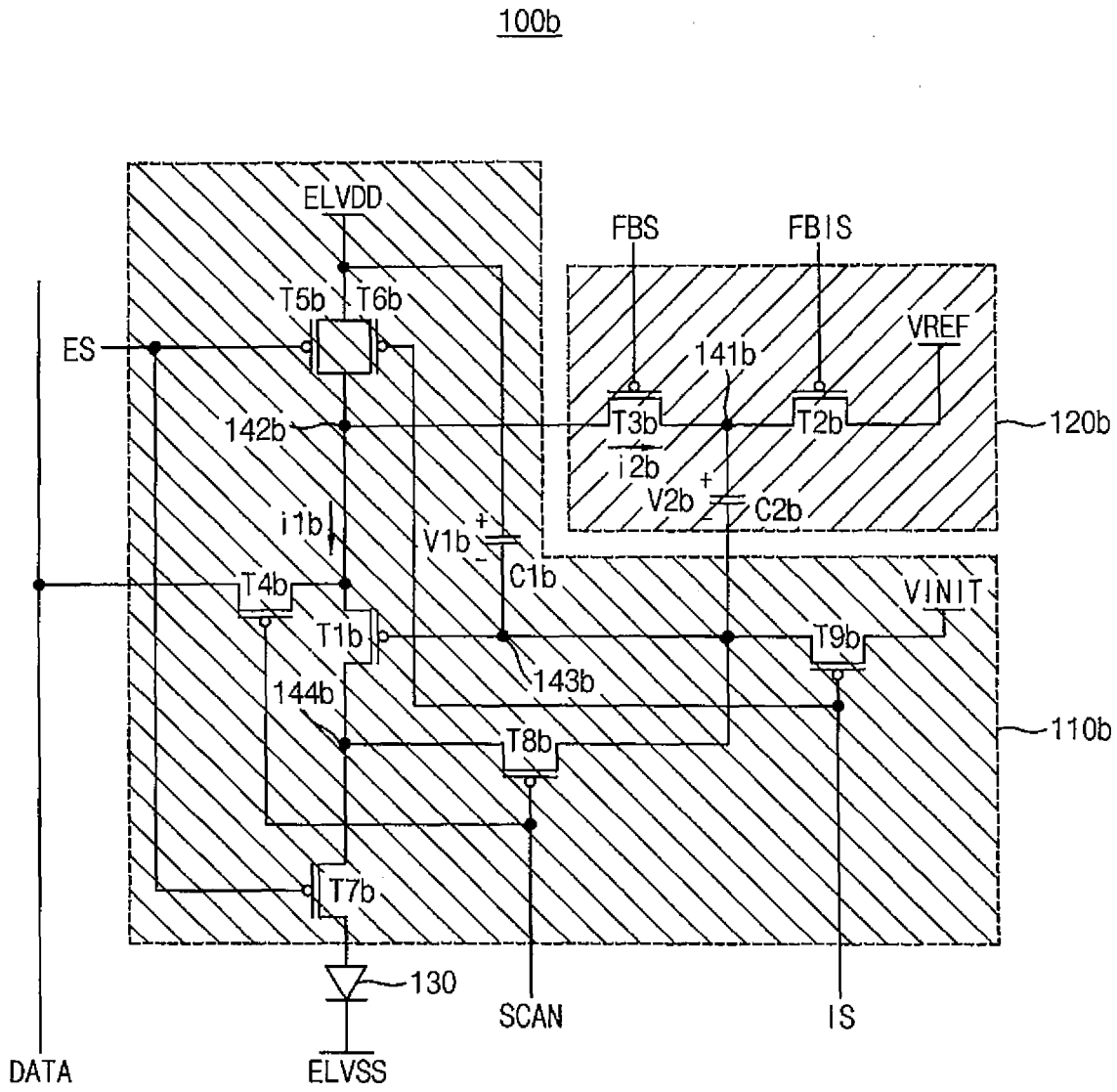
FIG. 7 is a schematic diagram illustrating a degradation compensating pixel circuit according to another example embodiment.

FIG. 7 is a block diagram illustrating a degradation compensating pixel circuit according to another example embodiment.

Referring to FIG. 7, a degradation compensating pixel circuit 100*b* includes an organic light emitting diode (OLED) 130, a driving circuit 110*b*, and a degradation compensating circuit 120*b*. The driving circuit 110*b* includes a first transistor T1*b* (e.g., PMOS transistor), fourth through ninth transistors T4*b*, T5*b*, T6*b*, T7*b*, T8*b*, and T9*b* (e.g., PMOS transistors), and a first capacitor C1*b*. The degradation compensating circuit 120*b* includes second and third transistors T2*b* and T3*b* (e.g., PMOS transistors), and a second capacitor C2*b*.

A reference voltage VREF may be applied to a source terminal of the second transistor T2*b*, a feedback initialization signal FBIS may be applied to a gate terminal of the second transistor T2*b*, and a drain terminal of the second transistor T2*b* may be coupled (e.g., connected) to a first node 141*b*. A source terminal of the third transistor T3*b* may be coupled to the first node 141*b*, a feedback signal FBS may be applied to a gate terminal of the third transistor T3*b*, and a drain terminal of the third transistor T3*b* may be coupled to a source terminal of the first transistor T1*b* through a second node 142*b*. A first terminal of the second capacitor C2*b* may be coupled to the first node 141*b*, and a second terminal of the second capacitor C2*b* may be coupled to a gate terminal of the first transistor T1*b* through a third node 143*b*.

A source terminal of the fourth transistor T4*b* may receive the data signal DATA, a gate terminal of the fourth transistor T4*b* may receive the scan signal SCAN, and a drain terminal of the fourth transistor T4*b* may be coupled to the second node 142*b*. A source terminal of the fifth transistor T5*b* may receive a supply voltage ELVDD, a gate terminal of the fifth transistor T5*b* may receive an enable signal ES, and a drain terminal of the fifth transistor T5*b* may be coupled to the second node 142*b*. A source terminal of the sixth transistor T6*b* may receive the supply voltage ELVDD, a gate terminal of the sixth transistor T6*b* may receive an initialization signal IS, and a drain terminal of the sixth transistor T6*b* may be coupled to the second node 142*b*. The source terminal of the first transistor T1*b* may be coupled to the second node 142*b*, the gate terminal of the first transistor T1*b* may be coupled to the third node 143*b*, and a drain terminal of the first transistor T1*b* may be coupled to a fourth node 144*b*. A source terminal of the seventh transistor T7*b* may be coupled to the fourth node 144*b*, a gate terminal of the seventh transistor T7*b* may receive the enable signal ES, and a drain terminal of the seventh transistor T7*b* may be coupled to a first terminal of the OLED 130. A source terminal of the eighth transistor T8*b* may be coupled to the fourth node 144*b*, a gate terminal of the eighth transistor T8*b* may receive the scan signal SCAN, and a drain terminal of the eighth transistor T8*b* may be coupled to the third node 143*b*. A source terminal of the ninth transistor T9*b* may be coupled to the third node 143*b*, a gate terminal of the ninth transistor T9*b* may receive the initialization signal IS, and a drain terminal of the ninth transistor T9*b* may receive an initialization voltage VINIT A second terminal of the OLED 130 may receive a ground voltage ELVSS.

Figure 8:
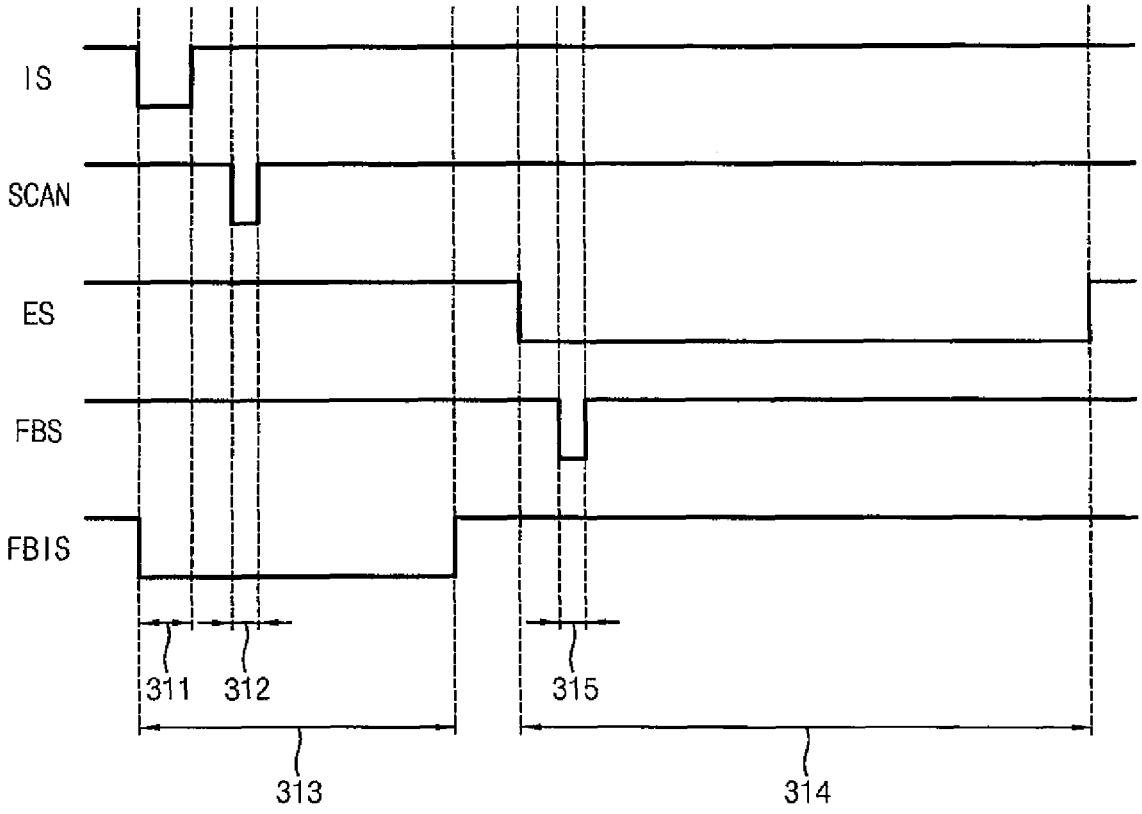
FIG. 8 is a timing diagram illustrating operation of the degradation compensating pixel circuit shown in FIG. 7.

FIG. 8 is a timing diagram illustrating operation of the degradation compensating pixel circuit shown in FIG. 7.

Referring to FIG. 8, the driving circuit 110*b* sets a voltage of the third node 143*b* as the initialization voltage VINIT during a first period 311 when the initialization signal IS is activated. The driving circuit 110*b* may charge the first capacitor C1*b* in response to the data signal DATA, and the driving circuit 110*b* may change the first voltage V1*b* to compensate threshold voltage difference of the first transistor T1*b*, during a second period 312 when the scan signal SCAN is activated. The degradation compensating circuit 120*b* may charge the second capacitor C2*b* during a third period 313 when the feedback initialization signal FBIS is activated, so that a second voltage V2*b* between the two terminals of the second capacitor C2*b* becomes a voltage difference between the reference voltage VREF and an initialization voltage VINIT. The OLED 130 may emit light during a fourth period 314 when the enable signal ES is activated.

The degradation compensating pixel circuit 100*b* may change the first voltage V1*b* by voltage distribution between the first capacitor C1*b* and the second capacitor C2*b* through a second current i2*b* during a fifth period 315 when the feedback signal FBS is activated and the enable signal ES is activated. Procedure of the voltage distribution between the first capacitor C1*b* and the second capacitor C2*b* through the second current i2*b* during the fifth period 315 may be understood based on the above description with references to FIGS. 5 and 6.

Figure 9:
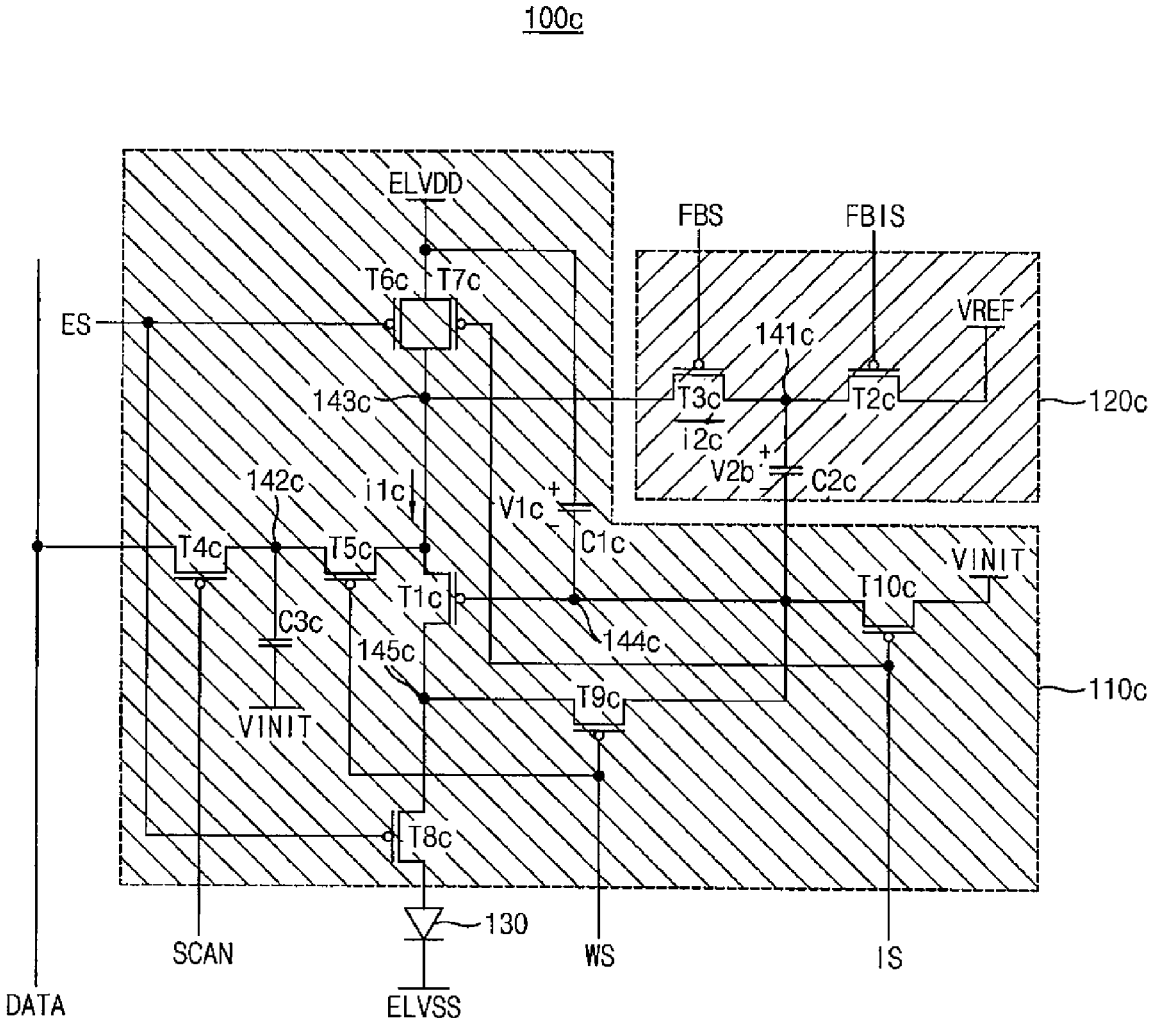
FIG. 9 is a schematic diagram illustrating a degradation compensating pixel circuit according to still another example embodiment.

FIG. 9 is a block diagram illustrating a degradation compensating pixel circuit according to still another example embodiment.

Referring to FIG. 9, the degradation compensating pixel circuit 100*c* includes an organic light emitting diode 130, a driving circuit 110*c*, and a degradation compensating circuit 120*c*. The driving circuit 110*c* includes a first transistor T1*c* (e.g., a PMOS transistor), fourth through tenth transistors T4*c*, T5*c*, T6*c*, T7*c*, T8*c*, T9*c*, and T10*c* (e.g., PMOS transistors), and first and third capacitors C1*c* and C3*c*. The degradation compensating circuit 120*c* includes second and third transistors T2*c* and T3*c* (e.g., PMOS transistors), and a second capacitor C2*c*.

A reference voltage VREF may be applied to a source terminal of the second transistor T2*c*, a feedback initialization signal FBIS may be applied to a gate terminal of the second transistor T2*c*, and a drain terminal of the second transistor T2*c* may be coupled (e.g., connected) to a first node 141*c*. A source terminal of the third transistor T3*c* may be coupled to the first node 141*c*, a feedback signal FBS may be applied to a gate terminal of the third transistor T3*c*, and a drain terminal of the third transistor T3*c* may be coupled to a source terminal of the first transistor T1*c* through a third node 143*c*. A first terminal of the second capacitor C2*c* may be coupled to the first node 141*c* and a second terminal of the second capacitor C2*c* may be coupled to a gate terminal of the first transistor T1*c* through a fourth node 144*c*.

A source terminal of the fourth transistor T4*c* may receive the data signal DATA, a gate terminal of the fourth transistor T4*c* may receive the scan signal SCAN, and a drain terminal of the fourth transistor T4*c* may be coupled to a second node 142*c*. A first terminal of the third capacitor C3*c* may be coupled to the second node 142*c* and a second terminal of the third capacitor C3*c* may receive an initialization voltage VINIT. A source terminal of the fifth transistor T5*c* may be coupled to the second node 142*c*, a gate terminal of the fifth transistor T5*c* may receive a compensation signal WS, and a drain terminal of the fifth transistor T5*c* may be coupled to the third node 143*c*. A source terminal of the sixth transistor T6*c* may receive a supply voltage ELVDD, a gate terminal of the sixth transistor T6*c* may receive an enable signal ES, and a drain terminal of the sixth transistor T6*c* may be coupled to the third node 143*c*. A source terminal of the seventh transistor T7*c* may receive the supply voltage ELVDD, a gate terminal of the seventh transistor T7*c* may receive an initialization signal IS, and a drain terminal of the seventh transistor T7*c* may be coupled to the third node 143*c*. The source terminal of the first transistor T1*c* may be coupled to the third node 143*c*, the gate terminal of the first transistor T1*c* may be coupled to the fourth node 144*c*, and a drain terminal of the first transistor T1*c* may be coupled to a fifth node 145*c*. A source terminal of the eighth transistor T8*c* may be coupled to the fifth node 145*c*, a gate terminal of the eighth transistor T8*c* may receive the enable signal ES, and a drain terminal of the eight transistor T8*c* may be coupled to a first terminal of the OLED 130. A source terminal of the ninth transistor T9*c* may be coupled to the fifth node 145*c*, a gate terminal of the ninth transistor T9*c* may receive the compensation signal WS, and a drain terminal of the ninth transistor T9*c* may be coupled to the fourth node 144*c*. A source terminal of the tenth transistor T10*c* may be coupled to the fourth node 144*c*, a gate terminal of the tenth transistor T10*c* may receive the initialization signal IS, and a drain terminal of the tenth transistor T10*c* may receive an initialization voltage VINIT. A second terminal of the OLED 130 may receive a ground voltage ELVSS.

Figure 10:
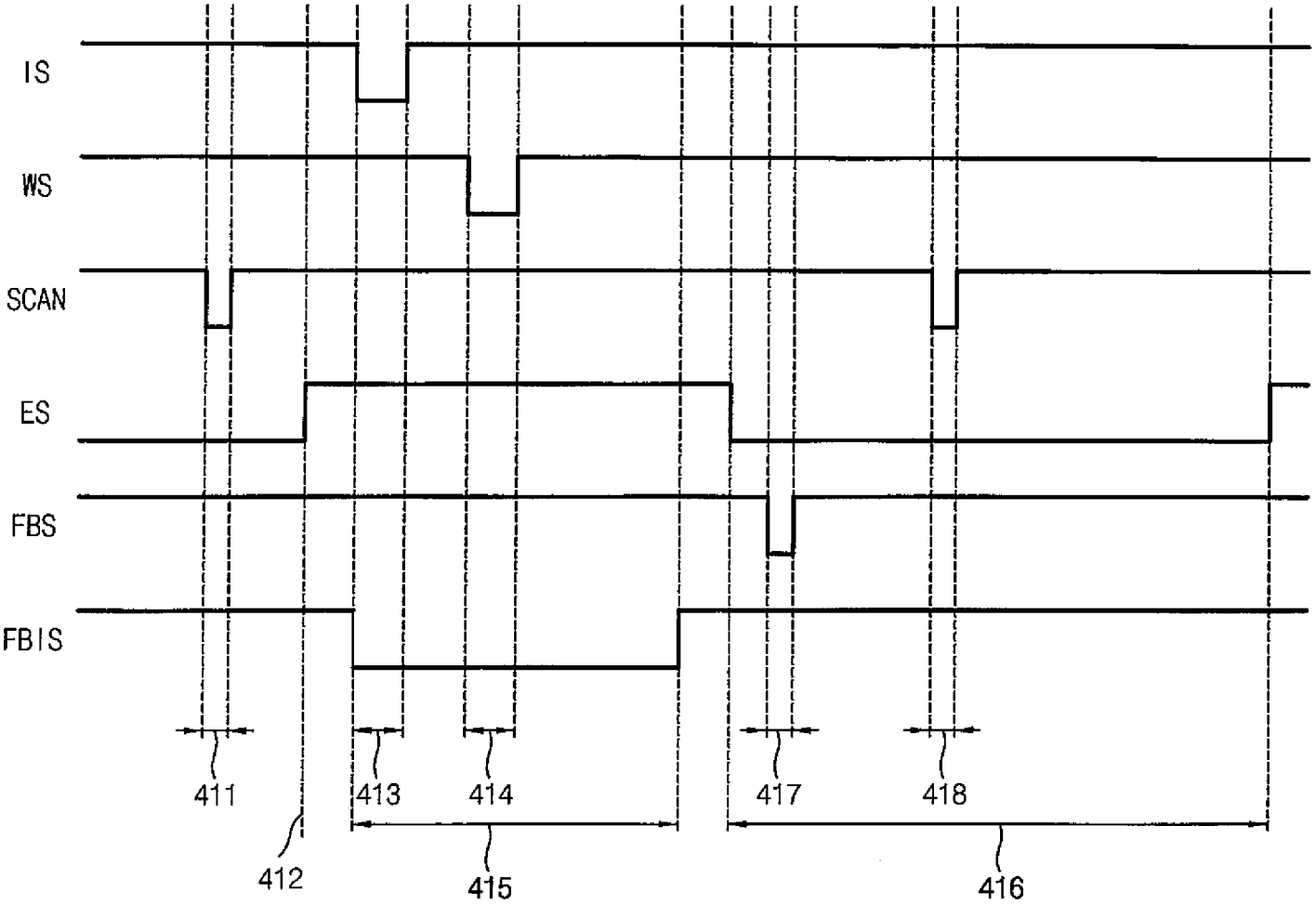
FIG. 10 is a timing diagram illustrating operation of the degradation compensating pixel circuit shown in FIG. 9.

FIG. 10 is a timing diagram illustrating operation of the degradation compensating pixel circuit shown in FIG. 9.

Referring to FIG. 10, the driving circuit 110*c* may charge the third capacitor C3*c* in response to the data signal DATA of a first frame during a first period 411 when the scan signal SCAN is activated. Light emission of the first frame is completed at a first time point 412 when the enable signal ES is deactivated.

The driving circuit 110*c* sets a voltage of the fourth node 144*c* as the initialization voltage VINIT during a second period 413 when the initialization signal IS is activated. The driving circuit 110*c* may charge the first capacitor C1*c* based on the voltage of the third capacitor C3*c*, and the driving circuit 110*c* may change the first voltage V1*c* to compensate threshold voltage difference of the first PMOS transistor T1*c* during a third period 414 when the compensation signal WS is activated. The degradation compensating circuit 120*c* may charge the second capacitor C2*c* during a fourth period 415 when the feedback initialization signal FBIS is activated, so that a second voltage V2*c* between the two terminals of the second capacitor C2*c* becomes a voltage difference between the reference voltage VREF and the initialization voltage VINIT. The OLED 130 may emit light in response to the voltage of the first capacitor C1*c* during a fifth period 416 when the enable signal ES is activated.

The degradation compensating pixel circuit 100*c* may change the first voltage V1*c* by voltage distribution between the first capacitor C1*c* and the second capacitor C2*c* through a second current i2*c* during a sixth period 417 when the feedback signal FBS is activated and the enable signal ES is activated. Procedure of the voltage distribution between the first capacitor C1*c* and the second capacitor C2*c* through the second current i2*c* during the sixth period 417 may be understood based on the above description with references to FIGS. 5 and 6.

The driving circuit 110*c* may charge the third capacitor C3*c* in response to the data signal DATA of a second frame during a seventh period 418 when the scan signal SCAN is activated.

Figure 11:
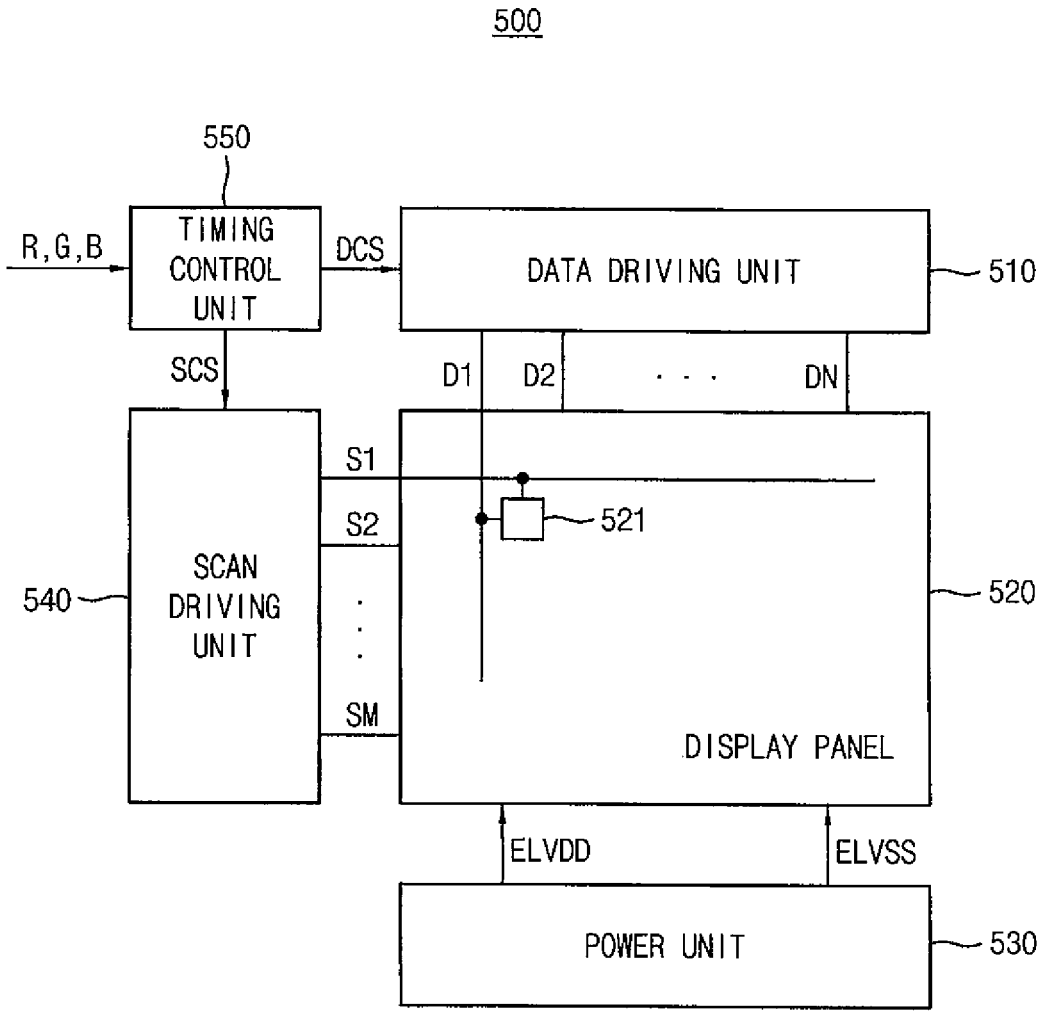
FIG. 11 is a block diagram illustrating an organic light emitting diode (OLED) display device including a degradation compensating pixel circuit according to an example embodiment.

FIG. 11 is a block diagram illustrating an organic light emitting diode (OLED) display device including a degradation compensating pixel circuit according to an example embodiment.

Referring to FIG. 11, the organic light emitting diode (OLED) display device 500 includes a timing control unit 550 (e.g., a timing controller), a display panel 520 (e.g., a display), a data driving unit 510 (e.g., a data driver), a scan driving unit 540 (e.g., a scan driver), and a power unit 530 (e.g., a power supply). The timing control unit 550 generates a data driving unit control signal DCS and a scan driving unit control signal SCS based on an input image data signal R, G, B. The display panel 520 includes a plurality of degradation compensating pixel circuits 521. The data driving unit 510 generates data signals based on the data driving unit control signal DCS, and provides the data signals to the degradation compensating pixel circuits 521 through a plurality of data lines D1 through DN. The scan driving unit 540 generates scan signals based on the scan driving unit control signal SCS, and provides the scan signals to the degradation compensating pixel circuits 521 through a plurality of scan lines S1 through SM. The power unit 530 provides a supply voltage ELVDD and a ground voltage ELVSS to the display panel 520 to operate the display panel 520.

Each of the degradation compensating pixel circuits 521 may be one of the degradation compensating pixel circuits 100, 100*a*, 100*b*, and 100*c* as shown in FIGS. 1, 2, 7, and 9. The degradation compensating pixel circuits 521 may be understood based on the above description with references to FIGS. 1 through 10.

Figure 12:
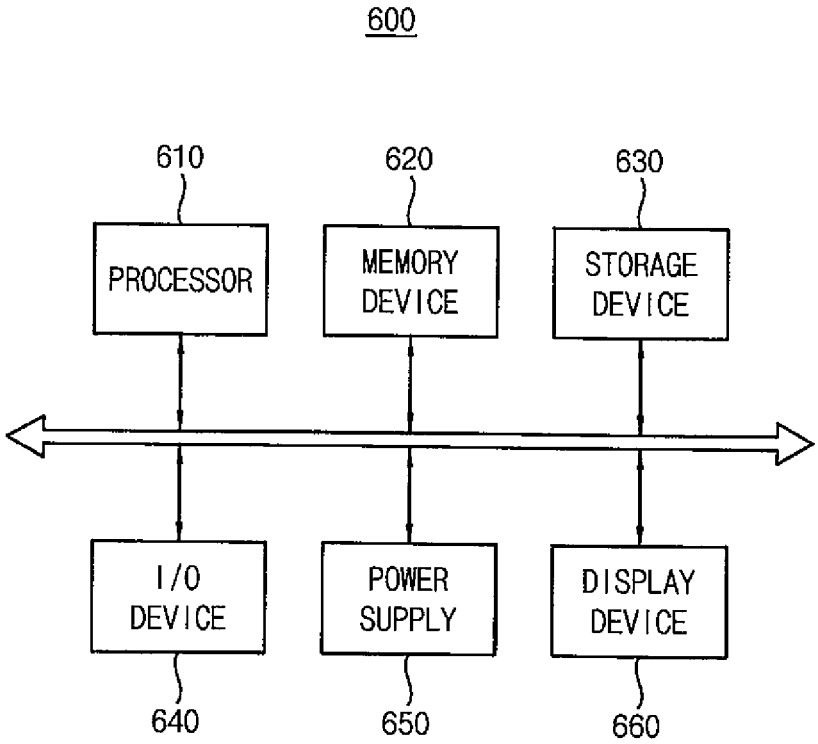
FIG. 12 is a block diagram illustrating an electronic device including an OLED display device according to an example embodiment.

FIG. 12 is a block diagram illustrating an electronic device including an OLED display device according to an example embodiment.

Referring to FIG. 12, an electronic device 600 may include a processor 610, a memory device 620, a storage device 630, an input/output (I/O) device 640, a power supply 650, and a display device 660. Here, the electronic device 600 may further include a plurality of ports for communicating with a video card, a sound card, a memory card, a universal serial bus (USB) device, other electronic devices, etc. Further, the electronic device 600 may be implemented as a smart-phone, but the present invention is not limited thereto.

The processor 610 may perform various computing functions. The processor 610 may be a microprocessor, a central processing unit (CPU), etc. The processor 610 may be coupled to other components via an address bus, a control bus, a data bus, etc. Further, the processor 610 may be coupled to an extended bus, such as a peripheral component interconnection (PCI) bus.

The memory device 620 may store data for operations of the electronic device 600. For example, the memory device 620 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 630 may be a solid state drive (SSD) device, a hard disk drive (HDD) device, a CD-ROM device, etc. The I/O device 640 may be an input device such as a keyboard, a keypad, a touchpad, a touch-screen, a mouse, etc, and an output device such as a printer, a speaker, etc. The power supply 650 may provide power for operations of the electronic device 600. The display device 660 may communicate with other components via the buses or other communication links.

The display device 660 may be the OLED display device 500 of FIG. 11. The display device may be understood based on the above description with references to FIGS. 1 through 11.

The example embodiments may be applied to any electronic device 600 (e.g., electronic system) having the display device 660. For example, the described example embodiments herein may be applied to electronic devices 600, such as a digital or 3D television, a computer monitor, a home appliance, a laptop, a digital camera, a cellular phone, a smart phone, a personal digital assistant (PDA), a portable multimedia player (PMP), a MP3 player, a portable game console, a navigation system, a video phone, etc.

Aspects of the present invention may be applied to an OLED display device and an electronic device including the same. For example, the aspects of the present invention may be applied to a monitor, a television, a computer, a laptop computer, a digital camera, a mobile phone, a smartphone, a smart pad, a PDA, a PMP, a MP3 player, a navigation system, a camcorder, etc.

The foregoing is illustrative of example embodiments and is not to be construed as limiting thereof. Although a few example embodiments have been described, those skilled in the art will readily appreciate that various modifications are possible in the example embodiments without materially departing from the spirit and scope of the present inventive concept. Accordingly, all such modifications are intended to be included within the spirit and scope of the present inventive concept as defined in the claims, and their equivalents. Therefore, it is to be understood that the foregoing is illustrative of various example embodiments only, and is not to be construed as limited to the specific example embodiments disclosed herein, and that various modifications to the disclosed example embodiments, as well as other example embodiments, are intended to be included within the spirit and scope of the appended claims, and their equivalents.

What is claimed is:

1. A degradation compensating pixel circuit, comprising:

an organic light emitting diode (OLED);

a driving circuit comprising a first capacitor and a first transistor, the first capacitor being configured to be charged in response to a data signal and a scan signal, the first transistor being configured to drive the OLED according to a first voltage between first and second terminals of the first capacitor, the first terminal of the first capacitor being configured to receive a supply voltage, the second terminal of the first capacitor being coupled to a gate terminal of the first transistor; and a degradation compensating circuit coupled to a source terminal of the first transistor and the gate terminal of the first transistor, the degradation compensating circuit being configured to change the first voltage according to a first current of the first transistor, wherein the degradation compensating circuit comprises a second transistor, a third transistor, and a second capacitor, wherein a source terminal of the second transistor is configured to receive a reference voltage, a gate terminal of the second transistor is configured to receive a feedback initialization signal, and a drain terminal of the second transistor is coupled to a first node, wherein a source terminal of the third transistor is coupled to the first node, a gate terminal of the third transistor is configured to receive a feedback signal, and a drain terminal of the third transistor is coupled to the source terminal of the first transistor, and wherein a first terminal of the second capacitor is coupled to the first node, and a second terminal of the second capacitor is coupled to the gate terminal of the first transistor.

2. The degradation compensating pixel circuit of claim 1, wherein the degradation compensating circuit is configured to increase the first current by increasing the first voltage and decreasing a voltage of the gate terminal of the first transistor when the first current is reduced by degradation of the first transistor.

3. The degradation compensating pixel circuit of claim 1, wherein the first current flows from the source terminal of the first transistor to a drain terminal of the first transistor through the first transistor when the OLED emits light.

4. The degradation compensating pixel circuit of claim 1, wherein the degradation compensating circuit is configured to charge the second capacitor during a first period when the feedback initialization signal is activated so that a second voltage between the first and second terminals of the second capacitor becomes a voltage difference between the reference voltage and an initialization voltage.

5. The degradation compensating pixel circuit of claim 4, wherein the degradation compensating pixel circuit is configured to change the first voltage by a voltage distribution between the first capacitor and the second capacitor through a second current during a second period when the feedback signal is activated and an enable signal is activated.

6. The degradation compensating pixel circuit of claim 5, wherein an amount of the second current between the first capacitor and the second capacitor is proportional to an amount of the first current.

7. The degradation compensating pixel circuit of claim 5, wherein the second period is after the first period.

8. The degradation compensating pixel circuit of claim 1, wherein a capacitance of the second capacitor is larger than a capacitance of the first capacitor.

9. The degradation compensating pixel circuit of claim 1, wherein the driving circuit further comprises fourth, fifth, sixth, and seventh transistors, wherein a source terminal of the fourth transistor is configured to receive the data signal, a gate terminal of the fourth transistor is configured to receive the scan signal, and a drain terminal of the fourth transistor is coupled to a second node, wherein a source terminal of the fifth transistor is coupled to the second node, a gate terminal of the fifth transistor is configured to receive the feedback initialization signal, and a drain terminal of the fifth transistor is configured to receive an initialization voltage, wherein a source terminal of the sixth transistor is configured to receive the supply voltage, a gate terminal of the sixth transistor is configured to receive an enable signal, and a drain terminal of the sixth transistor is coupled to a third node, wherein the source terminal of the first transistor is coupled to the third node, and the gate terminal of the first transistor is coupled to the second node, wherein a source terminal of the seventh transistor is coupled to a drain terminal of the first transistor, a gate terminal of the seventh transistor is configured to receive the enable signal, and a drain terminal of the seventh transistor is coupled to a first terminal of the OLED, and wherein a second terminal of the OLED is configured to receive a ground voltage.

10. The degradation compensating pixel circuit of claim 9, wherein the driving circuit is configured to charge the first capacitor according to the data signal when the scan signal is activated.

11. The degradation compensating pixel circuit of claim 9, wherein the OLED is configured to emit light when the enable signal is activated.

12. The degradation compensating pixel circuit of claim 1, wherein the driving circuit further comprises fourth, fifth, sixth, seventh, eighth, and ninth transistors, wherein a source terminal of the fourth transistor is configured to receive the data signal, a gate terminal of the fourth transistor is configured to receive the scan signal, and a drain terminal of the fourth transistor is coupled to a second node, wherein a source terminal of the fifth transistor is configured to receive the supply voltage, a gate terminal of the fifth transistor is configured to receive an enable signal, and a drain terminal of the fifth transistor is coupled to the second node, wherein a source terminal of the sixth transistor is configured to receive the supply voltage, a gate terminal of the sixth transistor is configured to receive an initialization signal, and a drain terminal of the sixth transistor is coupled to the second node, wherein the source terminal of the first transistor is coupled to the second node, the gate terminal of the first transistor is coupled to a third node, and a drain terminal of the first transistor is coupled to a fourth node, wherein a source terminal of the seventh transistor is coupled to the fourth node, a gate terminal of the seventh transistor is configured to receive the enable signal, and a drain terminal of the seventh transistor is coupled to a first terminal of the OLED, wherein a source terminal of the eighth transistor is coupled to the fourth node, a gate terminal of the eighth transistor is configured to receive the scan signal, and a drain terminal of the eighth transistor is coupled to the third node, wherein a source terminal of the ninth transistor is coupled to the third node, a gate terminal of the ninth transistor is configured to receive the initialization signal, and a drain terminal of the ninth transistor is configured to receive an initialization voltage, and wherein a second terminal of the OLED is configured to receive a ground voltage.

13. The degradation compensating pixel circuit of claim 12, wherein the driving circuit is configured to change the first voltage to compensate threshold voltage difference of the first transistor in response to the initialization signal and the scan signal.

14. The degradation compensating pixel circuit of claim 1, wherein the driving circuit further comprises fourth, fifth, sixth, seventh, eighth, ninth, and tenth transistors, and a third capacitor, wherein a source terminal of the fourth transistor is configured to receive the data signal, a gate terminal of the fourth transistor is configured to receive the scan signal, and a drain terminal of the fourth transistor is coupled to a second node, wherein a first terminal of the third capacitor is coupled to the second node, and a second terminal of the second third capacitor is configured to receive an initialization voltage, wherein a source terminal of the fifth transistor is coupled to the second node, a gate terminal of the fifth transistor is configured to receive a compensation signal, and a drain terminal of the fifth transistor is coupled to a third node, wherein a source terminal of the sixth transistor is configured to receive the supply voltage, a gate terminal of the sixth transistor is configured to receive an enable signal, and a drain terminal of the sixth transistor is coupled to the third node, wherein a source terminal of the seventh transistor is configured to receive the supply voltage, a gate terminal of the seventh transistor is configured to receive an initialization signal, and a drain terminal of the seventh transistor is coupled to the third node, wherein the source terminal of the first transistor is coupled to the third node, the gate terminal of the first transistor is coupled to a fourth node, and a drain terminal of the first transistor is coupled to a fifth node, wherein a source terminal of the eighth transistor is coupled to the fifth node, a gate terminal of the eighth transistor is configured to receive the enable signal, and a drain terminal of the eighth transistor is coupled to a first terminal of the OLED, wherein a source terminal of the ninth transistor is coupled to the fifth node, a gate terminal of the ninth transistor is configured to receive the compensation signal, and a drain terminal of the ninth transistor is coupled to the fourth node, wherein a source terminal of the tenth transistor is coupled to the fourth node, a gate terminal of the tenth transistor is configured to receive the initialization signal, and a drain terminal of the tenth transistor is configured to receive an initialization voltage, and wherein a second terminal of the OLED is configured to receive a ground voltage.

15. A organic light emitting diode (OLED) display device, comprising:

a timing controller configured to generate a data driver control signal and a scan driver control signal according to an input image data signal;

a display panel comprising a plurality of degradation compensating pixel circuits;

a data driver configured to generate data signals according to the data driver control signal, and to provide the data signals to the degradation compensating pixel circuits through a plurality of data lines;

a scan driver configured to generate scan signals according to the scan driver control signal, and to provide the scan signals to the degradation compensating pixel circuits through a plurality of scan lines; and a power supply configured to provide a supply voltage and a ground voltage to the display panel to operate the display panel, each of the degradation compensating pixel circuits comprising:

an organic light emitting diode (OLED);

a driving circuit comprising a capacitor and a driving transistor, the capacitor being configured to be charged in response to a data signal from among the data signals and a scan signal from among the scan signals, the driving transistor being configured to drive the OLED according to a voltage between first and second terminals of the capacitor, the first terminal of the capacitor being configured to receive the supply voltage, the second terminal of the capacitor being coupled to a gate terminal of the driving transistor; and a degradation compensating circuit coupled to a source terminal of the driving transistor and the gate terminal of the driving transistor, the degradation compensating circuit being configured to change a voltage between the first and second terminals of the capacitor according to a current of the driving transistor, wherein the degradation compensating circuit comprises a second transistor, a third transistor, and a second capacitor, wherein a source terminal of the second transistor is configured to receive a reference voltage, a gate terminal of the second transistor, is configured to receive a feedback initialization signal, and a drain terminal of the second transistor is coupled to a first node, wherein a source terminal of the third transistor is coupled to the first node, a gate terminal of the third transistor is configured to receive a feedback signal, and a drain terminal of the third transistor is coupled to the source terminal of the driving transistor, and wherein a first terminal of the second capacitor is coupled to the first node, and a second terminal of the second capacitor is coupled to the gate terminal of the driving transistor.

* * * * *